US005409438A

United States Patent [19]

Jones et al.

[11] Patent Number: 5,409,438

[45] Date of Patent: Apr. 25, 1995

[54] LATERAL RAISE EXERCISE MACHINE

[75] Inventors: Arthur A. Jones; Clay J. Steffee, both of Ocala, Fla.

[73] Assignee: MedX Corporation, Ocala, Fla.

[21] Appl. No.: 179,705

[22] Filed: Jan. 11, 1994

Related U.S. Application Data

[63] Continuation-in-part of Ser. No. 921,112, Jul. 29, 1992, Pat. No. 5,338,274.

[51] Int. Cl.[6] ..... A63B 21/062

[52] U.S. Cl. ..... 482/100; 482/98; 482/134; 482/137

[58] Field of Search ..... 482/98, 99, 100, 97, 482/135, 136, 137, 138, 134

[56] References Cited

U.S. PATENT DOCUMENTS

| | | | |
|---|---|---|---|
| 3,912,261 | 10/1975 | Lambert, Sr. | 482/136 |
| 4,900,018 | 2/1990 | Ish, III et al. | 482/138 |
| 4,949,951 | 8/1990 | Deola | 482/100 |
| 5,171,198 | 12/1992 | Jones | 482/97 |

FOREIGN PATENT DOCUMENTS

| | | | |
|---|---|---|---|
| 8501446 | 4/1985 | WIPO | 482/137 |

*Primary Examiner*—Richard J. Apley
*Assistant Examiner*—Lynne A. Reichard
*Attorney, Agent, or Firm*—William E. Mouzavires

[57] ABSTRACT

A lateral raise exercise machine having a movement arm pivotable about an axis extending in a horizontal plane but inwardly at an angle of about 25° relative to the forward-rearward direction, a weight stack having at least one resistance weight, and transmission including a belt and pulley and a linkage interconnecting the movement arm and the weight to raise the weight when the movement arm is raised to a first position. The movement arm has a handle bar, mounted for adjustment about an axis which generally coincides with the axis of the humerus of the exerciser. A forearm pad is fixed to the handle bar to be adjustable together with the handle bar relative to the movement arm.

20 Claims, 4 Drawing Sheets

LATERAL RAISE EXERCISE MACHINE

RELATED APPLICATION

This application is a continuation-in-part of U.S. application Ser. No. 07/921,112, filed Jul. 29, 2992, now U.S. Pat. No. 5,338,274.

BACKGROUND OF THE INVENTION

The present invention generally relates to machines for exercising the muscles of the upper shoulder, deltoid muscles (delts), and laticimus dorcii muscles (lats). Numerous machines exist and have been known in the prior art for exercising the aforementioned parts of the human body. Such machines commonly utilize some sort of a movement arm which is moved by the body upon exertion of the muscles to be exercised and against a resistance, typically a weight stack or a free weight mounted on the movement arm. In the former, the movement arm is usually connected to the weight stack by an overhead cable and pulley system which increases the height of the machine and also introduces a certain amount of friction in the transmission of the drive thereby reducing efficiency. Machines of this type of the prior art also usually have parallel or coincident axes of rotation with the handles or user grips of such machines being unadjustable. This type of configuration can cause undue strain on the limbs and shoulder joints of the user and does not allow a full range of motion or muscular contraction.

Other types of exercise machines of the prior art use "free" weights as opposed to a weight stack. Free weights are typically interchangeable about a member protruding from the movement arm. An example of such a machine is shown in U.S. Pat. No. 5,171,198, Gary Jones. Although these "free" weight lateral raise machines eliminate the need for a cable or other transmission system between the movement arm and the weight stack, they have certain disadvantages in that it takes time and effort to change the weight each time a new repetition or exercise is to be performed. Also "free" weights are not always balanced and can subject the exerciser to jerky movements which can damage the muscles or lessen the efficiency of the exercise. Although the machine disclosed in the aforementioned U.S. Pat. No. 5,172,198 discloses angled pivot axes of the movement arms, the range of motion and muscular contraction is still limited.

OBJECTS OF THE PRESENT INVENTION

An object of the present invention is to provide a novel and improved lateral raise exercise machine which utilizes a weight stack for resistance to the movement arm but which eliminates the need of an overhead cable and pulley system for transmitting the drive from the movement arm to the weight stack.

A further object of the present invention is to provide an exercise machine utilizing a resistance weight stack while incorporating a novel and improved drive transmission between the movement arm and the weight stack.

Another object of the present invention is to provide a lateral raise exercise machine which avoids or minimizes stress in the shoulder joints. Included herein is such a machine that is adjustable to suit the size of a particular user.

A further object of the present invention is to provide a novel and improved lateral raise exercise machine which features easy accessibility to the weight stack, and weight selection in small or large increments.

A still further object of the present invention is to provide a novel and improved lateral raise exercise machine which achieves the above objects and yet is safe and effective.

SUMMARY OF INVENTION

In summary, the preferred embodiment of the present invention takes the form of a lateral raise machine having movement arms pivotable about axes lying in a horizontal plane but extending at an angle, preferably 50°, to each other while converging forwardly of the machine. The movement arms have cams fixed to them respectively, and a drive transmission member preferably a strap is fixed to and interconnects the cams while being trained about a pulley positioned intermediate the cams. The pulley is connected to a vertical drive member such as a sprocket chain which at its lower end is connected to a main lever or link which, in turn, is pivotally connected to a weight stack pin. Opposite the weight stack pin, the main lever is pivotally connected to a link which, in turn, is pivotally connected to a fixed point such as on the support frame of the machine. The movement arms each include an adjustable handle adjustable about an axis which generally coincides with the axis of the upper arm, i.e., the humerus. This allows the position of the arms to be adjusted to the proper position which adjustment together with the angular orientation of the pivotal axes of the movement arms, avoids stress or pain in the shoulder joints during an exercise when the arms are raised to move the movement arms against the resistance of the weight stack. The handles are also provided with pads engageable by the elbows and adjustable with the handles.

DRAWINGS

Other objects and advantages of the present invention will become apparent from the following more detailed description taken in conjunction with the attached drawings in which.

DETAILED DESCRIPTION

Figure 1:
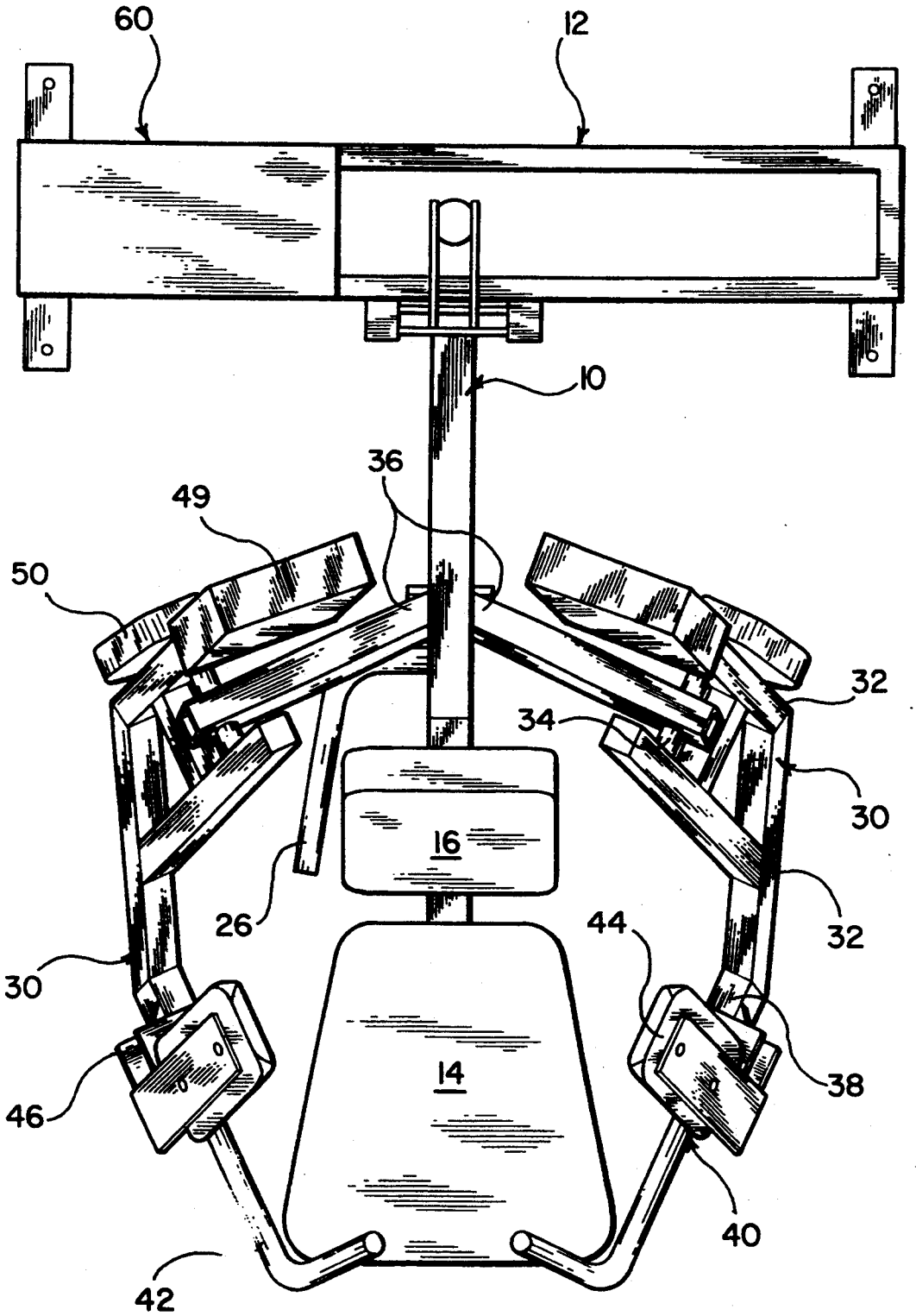
FIG. 1 is a top plan view of a lateral raise exercise machine constituting a preferred embodiment of the present invention.
Figure 2:
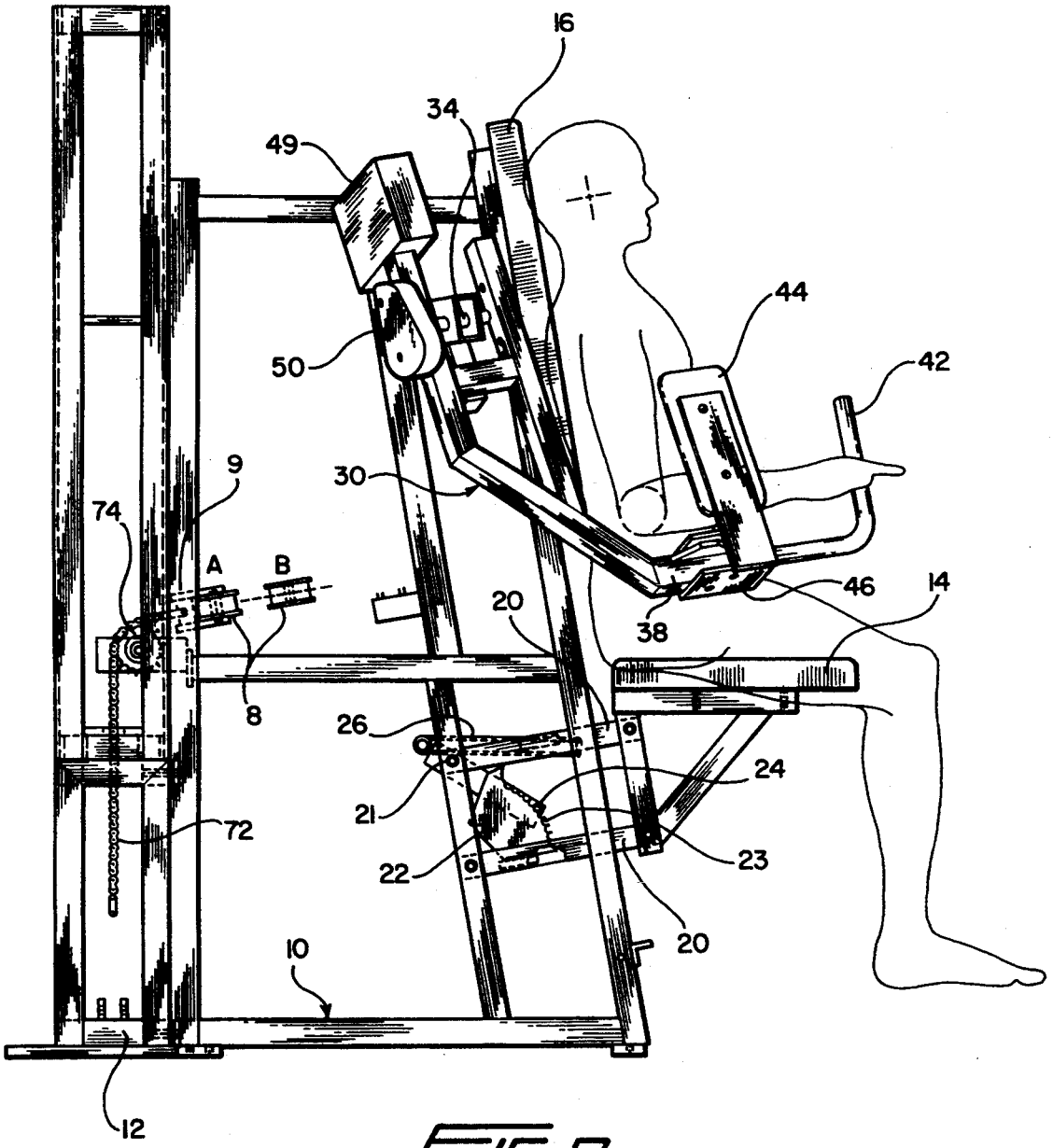
FIG. 2 is a side elevational view of the machine taken from the right side thereof with the weight stack removed for clarity.

Referring now to the drawings in detail, there is shown for illustrative purposes only a lateral raise exercise machine which constitutes a preferred embodiment of the present invention. As shown in FIG. 1, the preferred embodiment includes a generally horizontal seat 14 and a backrest 16 which are mounted on a frame generally designated 10. Referring to FIG. 2 the seat is adjustable vertically by means of a parallel linkage including opposite parallel links 20 pivoted at 21 to the frame while being pivotally connected to the frame underlying the seat 14. Seat 14 is held in the adjusted position by means of a latch mechanism which in the specific embodiment shown includes a latch plate 22 having a series of notches 23 along the edge for receiving a latch pin 24 that is moved into and out of the notches 23 by means of a handle 26.

During an exercise, the user pivots his/her arms laterally outwardly and upwardly against a resistance provided by a weight stack generally designated 60 located in the rear of the machine. In effecting the exercise, the user's arms engages a pair of laterally spaced movement arms generally designated 30 mounted for movement about axes 34 lying in horizontal planes but extending at angles to each other while converging forwardly of the machine. It is preferred that the axes extend 50° relative to each other or to state this differently, 25° inwardly from vertical planes extending in the forward-rearward direction. As perhaps best shown in FIG. 1, the axes 34 are provided by shafts which are fixed in frame portions 36 which, in turn, are fixed to frame portion 10 on opposite sides thereof.

Figure 7:
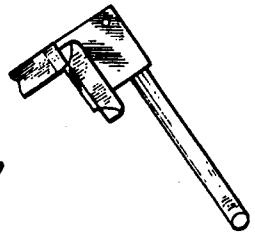
FIG. 7 is a view generally similar to FIG. 6 but showing the handle bar in another adjusted position.
Figure 6:
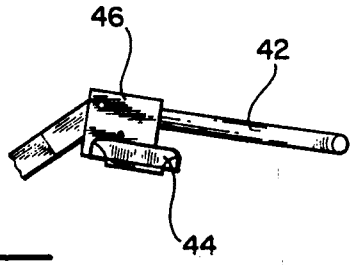
FIG. 6 is a view generally similar to FIG. 5 but showing a handle bar in one adjusted position.
Figure 4A:
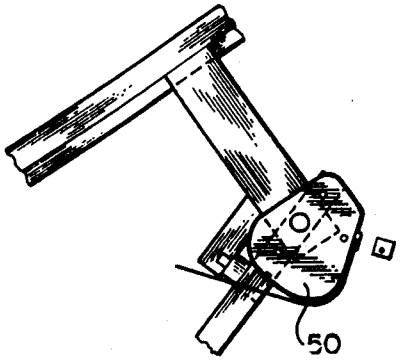
FIG. 4A is a side elevational view of a portion of a movement arm illustrating a cam fixed to the movement arm.
Figure 5:
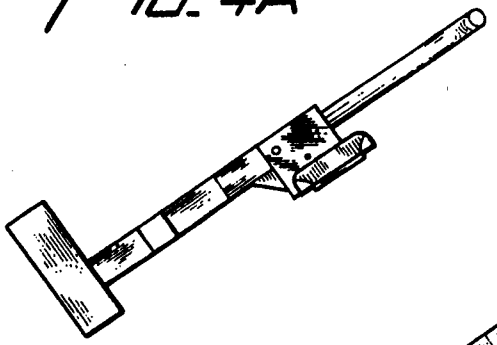
FIG. 5 is a fragmental plan view of portions of a movement arm included in the machine.

In the specific embodiment shown, each movement arm is bifurcated at portions 32 which are mounted on the shafts 34. The free ends of the movement arms are provided with handle bar assemblies generally designated 40 and including a handle bar 42 having a generally L-shaped hand grip and an elbow pad 44. In the specific embodiment shown, a receptacle including generally parallel plates 46 is pivotally mounted on portion 38 of the movement arm for movement between one extreme position shown in FIG. 5 where the handle bar extends in general alignment with movement arm portion 38 and in an other extreme position shown in FIG. 7 where the handle bar extends at generally 90° to movement arm portion 38. FIG. 6 shows one of several intermediate positions between those of FIGS. 5 and 7.

Figure 4:
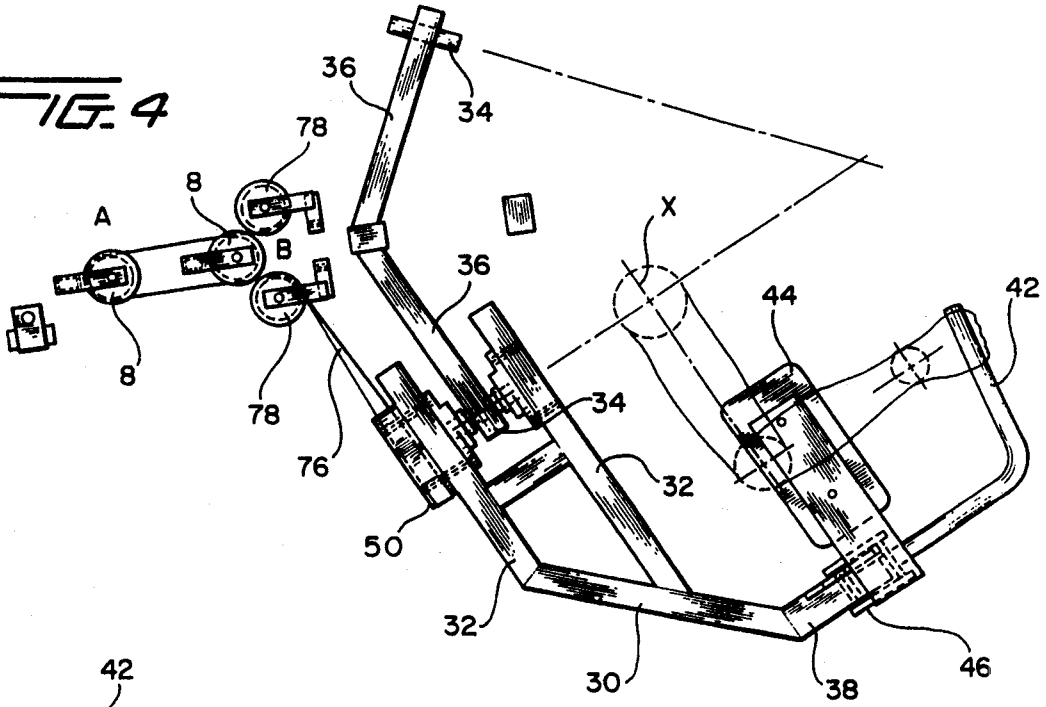
FIG. 4 is an elevational view of the movement arms included in the machine as well as portions of a pulley and strap transmission between the movement arm and a weight stack (not shown)
Figure 8:
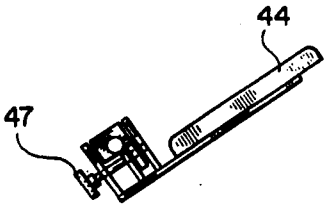
FIG. 8 is an elevational view showing an elbow pad included in the handle bar shown in FIGS. 5, 6 and 7.

Once in the desired adjusted position, the handle bars 42 are fixed in the position by means of a locking pin 47 shown in FIG. 8 being received in apertures that extend through receptacle plates 46 and portion 38 of the movement arm. Also in the specific embodiment, the elbow or forearm pad 44 is fixed to the receptacle plates 46 to be adjustable together with the handle bars relative to the movement arm. In accordance with a feature of the present invention, the axes of adjustable movement of the handle bars 42 coincides with the axes X of the upper arm (the humerus) as best shown in FIG. 4. In the preferred embodiment, a counterweight 49 is fixed to an upper portion of each of the movement arms to balance the movement arms about the shaft 34.

In accordance with another feature of the present invention, a novel drive transmission is used between the movement arms and the weight stack 60 to transmit movement from the movement arms to the weight stack to lift one or more weights in the weight stack as the exerciser raises the movement arms. In the preferred embodiment shown, the drive transmission includes cams 50 respectively fixed to the movement arms for pivotal movement with the movement arms as a unit; the cams 50 in the specific embodiment being fixed to the outer portions of the movement arms 30 as shown in FIGS. 1, 2 and 4 and 4A. A strap 76 made from flexible but high tensile strength material such as KEVLAR TM is fixed at its opposite ends to both of the cams 50 with its intermediate portion trained about a pulley 8 as best shown in FIG. 4. It is preferred that a pair of guide pulleys 78 be interposed between the cams 50 and the pulley 8 with the strap 76 engaged against the inside surfaces of the guide pulleys 78 as the strap changes its plane. Further in this regard, it will be noted that pulley 8 and guide pulleys 78 extend in generally horizontal planes to be rotatable about generally vertical axes while cams 50 extend in generally vertical planes to be rotatable about shafts 34 which extend in horizontal planes. Therefore, it is necessary for the strap 76 to be bent intermediate its ends from one plane to another plane.

Figure 3:
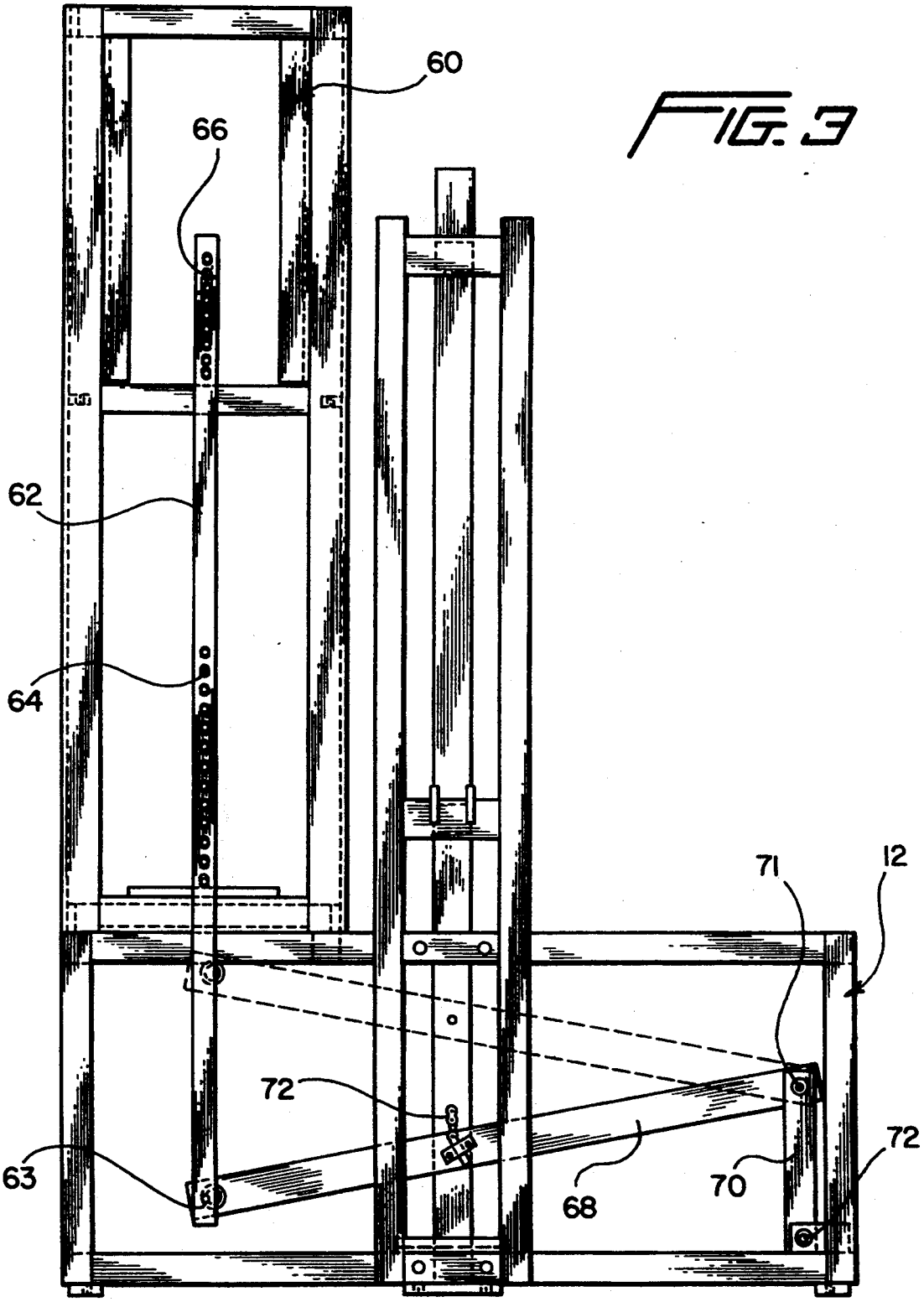
FIG. 3 is a front elevation view of the exercise machine with parts removed to show a linkage drive transmission to the weight stack.

When the movement arms 30 are raised, strap 76 will cause pulley 8 to move generally in the forward direction of the machine from position A to position B as shown in FIGS. 2 and 4. Referring to FIG. 2, pulley 8 is mounted in a block 9 which, in turn, is connected to a drive member preferably a sprocket chain 72 trained about a sprocket 74 extending in a vertical plane for rotation about horizontal axes fixed to the frame of the machine. Sprocket chain 72 descends at the rear of the machine where it is connected to an intermediate portion of a main lever or link 68 shown in FIG. 3. The latter is mounted to a rear frame 12 by means of a link 70 having one end pivotally connected at pin 71 to main lever 68 and another end pivotally connected by pin 72 to the frame 12 as best shown in FIG. 3. The opposite end of main lever 68 is pivotally connected by pin 63 to the lower end of a weight stack pin 62 included in the weight stack. The weight stack is preferably a compound weight stack such as disclosed in U.S. Pat. No. 4,834,365, issued May 30, 1989 and pending U.S. patent application Ser. No. 08/056,758, filed May 4, 1993 whose disclosures are hereby incorporated by reference into the present application as part hereof. The weight stack pin has upper and lower apertures 66 and 64 which receive pins for attaching weight plates to the pin as may be desired. It will be seen that when the exerciser raises the movement arms, pulley 8 will be drawn forwardly by strap 76 which, in turn, will raise sprocket chain 72 to pivot the main lever 68 about pivot pin 71 upwardly thereby raising the weight stack pin 62 and the weight plates (not shown) connected to the pin 62. During such movement of the main lever 68, the mounting link 70 will pivot about pivot axis 72 relative to the frame 12 to allow the weight stack pin 62 to be raised and lowered smoothly in a vertical line without jamming since link 70 will accommodate the arc of main lever 68. When the exerciser releases pressure on the movement arms to lower his arms to the starting position, the weight stack pin will descend, of course, by gravity whereby the main lever 68 will return to the lower position shown in FIG. 3.

Before starting any exercise, the exerciser sits on seat 14 and adjusts the vertical height of the seat to suit the size of the exerciser. The handle bars are then adjusted about axes which generally coincide with the axis of the upper arm or humerus. Such adjustment, together with the fact that the movement arm pivot axes 34 extend at the angle of fifty degrees (50°) to each other or 25° off a forward-rearward direction, the exerciser will avoid pain in his shoulder joints as he performs the exercise. Although a preferred embodiment of the present invention has been shown and described, it will be apparent to those of ordinary skill in the art that the present invention may be applied in other forms, the scope of which is indicated in the appended claims.

We claim:

1. A lateral raise exercise machine having a forward-rearward direction, a movement arm pivotable about an axis, said axis extending in a horizontal plane but inwardly at an angle of about 25° relative to the forward-rearward direction, a weight stack having at least one resistance weight, transmission means interconnecting the movement arm and the weight to raise the weight when the movement arm is raised to a first position, said movement arm having a handle bar, means mounting the handle bar relative to the movement arm for adjustable movement about a generally vertical axis allowing said handle bar to be adjusted generally about the axis of the humerus of the exerciser, and a forearm pad fixed to the handle bar to be adjustable together with the handle bar relative to the movement arm.

2. The lateral raise exercise machine defined in claim 1 wherein the transmission means includes a main lever located at a lower portion of the machine, a vertical drive member connected to the main lever and to the movement arm and wherein the main lever is connected to a weight stack pin located in the weight stack.

3. The machine defined in claim 2 wherein the transmission means includes a mounting link having one end pivotally mounted to a frame and having an opposite end pivotally connected to the main lever.

4. The machine defined in claim 2 wherein said transmission means includes a pulley having a mounting frame connected to the vertical drive member, and a strap trained about the pulley and connected to the movement arm.

5. The machine defined in claim 4 wherein the movement arm has a cam fixed thereto and wherein said strap is fixed to said cam.

6. The machine defined in claim 5 wherein said pulley extends in a generally horizontal plane.

7. The machine defined in claim 6 wherein the transmission means includes a pair of guide pulleys engaging portions of said strap and extending generally in horizontal planes.

8. The machine defined in claim 7 wherein said movement arm has bifurcated portions mounted about a shaft fixed to a frame, said shaft constituting the pivot axis of the movement arm.

9. The machine defined in claim 8 wherein said strap changes its plane at a location between the cam and the pulley.

10. The machine defined in claim 5 wherein said strap changes its plane at a location between the cam and the pulley.

11. An exercise machine comprising in combination, a pair of movement arms pivotable about an axis in response to pressure exerted by an exerciser, a weight stack having at least one resistance weight, and transmission means interconnecting the movement arms and the weight to raise the weight when the movement arms are moved to a first position, said transmission means including cams respectively fixed to the movement arms, a flexible drive member having opposite portions fixed to the cams respectively, a pulley about which an intermediate portion of the drive member is trained, said pulley being movable in translation in response to movement of the movement arms, a stack pin included in the weight stack and connected to said weight, means interconnecting said pulley and a lower portion of said stack pin to raise the pin when the movement arms are moved against the resistance of said weight, and wherein the transmission means further includes a main lever located at a lower portion of the machine, a vertical drive member connected to the main lever and to the pulley and wherein the main lever is pivotally connected to said stack pin.

12. The machine defined in claim 11 wherein the transmission means further includes a mounting link having one end pivotally mounted to a fixed support and having an opposite end pivotally connected to the main lever.

13. The machine defined in claim 12 wherein said drive member trained about said pulley is a strap member.

14. The machine defined in claim 12 wherein said pulley extends in a generally horizontal plane.

15. The machine defined in claim 11 wherein said pulley extends in a generally horizontal plane.

16. The machine defined in claim 15 wherein the transmission means includes a pair of guide pulleys engaging portions of said flexible drive member.

17. A lateral raise exercise machine having a forward-rearward direction, a movement arm pivotable about an axis, said axis extending in a horizontal plane but inwardly at an acute angle relative to the forward-rearward direction, a weight stack having at least one resistance weight, transmission means interconnecting the movement arm and the weight to raise the weight when the movement arm is raised to a first position, said movement arm having a handle bar, means mounting the handle bar relative to the movement arm for adjustable movement about a generally vertical axis allowing the exercise arm said handle bar to be adjusted generally about the axis of the humerus of the exerciser, and a forearm pad fixed to the handle bar to be adjustable together with the handle bar relative to the movement arm.

18. The lateral raise exercise machine defined in claim 17 wherein the transmission means includes a lever, a drive member connected to the lever and to the movement arm and wherein the lever is connected to a weight stack pin located in the weight stack.

19. An exercise machine comprising in combination, a pair of movement arms pivotable about an axis in response to pressure exerted by an exerciser, a weight stack having at least one resistance weight, and transmission means interconnecting the movement arms and the weight to raise the weight when the movement arms are moved to a first position, said transmission means including cams respectively fixed to the movement arms, a flexible drive member having opposite portions fixed to the cams respectively, a pulley about which an intermediate portion of the drive member is trained, said pulley being movable in translation in response to movement of the movement arms, a stack pin included in the weight stack and connected to said weight and means interconnecting said pulley and said stack pin to raise the pin when the movement arm is moved against the resistance of said weight and wherein the transmission means further includes a lever and drive member connected to the main lever and to the pulley.

20. The machine defined in claim 19 wherein said pulley extends in a generally horizontal plane and wherein the transmission means includes a pair of guide pulleys engaging portions of said flexible drive member.

* * * * *